US005514026A

United States Patent [19]

Schaffer

[11] Patent Number: 5,514,026

[45] Date of Patent: May 7, 1996

[54] UNITARY, HAND-HELD, PORTABLE, SELF-POWERED REFILLABLE MIXED-MEDIA EJECTOR TOOL

[75] Inventor: Stephen C. Schaffer, Brookfield, Conn.

[73] Assignee: Sandair Nevada, Inc., Sherman Oaks, Calif.

[21] Appl. No.: 140,224

[22] Filed: Oct. 20, 1993

[51] Int. Cl.[6] ..... B24C 3/00; B24C 5/04

[52] U.S. Cl. ..... 451/90; 451/91; 451/99

[58] Field of Search ..... 451/90, 91, 99, 451/75, 102, 344

[56] References Cited

U.S. PATENT DOCUMENTS

| | | | |
|---|---|---|---|
| 709,448 | 9/1902 | Shaver | 451/99 |
| 2,108,545 | 2/1938 | Minch | 51/436 |
| 2,133,149 | 10/1938 | Poncelet . | |
| 2,441,441 | 5/1948 | Paasche | 51/427 |
| 2,526,403 | 10/1950 | Paasche . | |
| 2,574,578 | 11/1951 | Martinet | 51/427 |
| 3,032,929 | 5/1962 | Glesener | 51/427 |
| 3,163,963 | 1/1965 | Caron . | |
| 3,626,841 | 12/1971 | Schachter | 451/99 |
| 3,704,811 | 12/1972 | Harden . | |
| 4,090,334 | 4/1978 | Kurowski | 51/436 |
| 4,233,785 | 11/1980 | Abell | 451/90 |
| 4,333,277 | 6/1982 | Tasedan | 51/427 |
| 4,628,644 | 12/1986 | Somers . | |
| 4,674,239 | 6/1987 | Jodoin . | |
| 4,941,298 | 7/1990 | Fernwood . | |
| 5,181,349 | 1/1993 | Schaeffer . | |

FOREIGN PATENT DOCUMENTS

| | | |
|---|---|---|
| 3624023 | 7/1986 | Germany . |
| 2102315 | 2/1983 | United Kingdom . |

*Primary Examiner*—Bruce M. Kisliuk
*Assistant Examiner*—Derris Banks

[57] ABSTRACT

A symmetrically balanced, integrated, portable, refillable, serviceable, adjustable, self contained tool, suitable for single hand operation, for ejecting a stream of particulate, powdered, or liquid material toward a target combining a supply reservoir containing the materials, a portable propellant container adapted to the supply reservoir, carrying compressed propellant liquid, a propellant release valve delivering propellant from the container via a constricted air jet orifice to a angular mixing chamber positioned above the uppermost level of materials the materials supply reservoir, a delivery conduit connecting the lower portion of the supply materials reservoir chamber to the angular mixing chamber through an adjustment valve, delivering a stream of materials aspirated from the materials supply reservoir by the negative atmospheric pressure deferential created by a Venturi effect to the angular mixing chamber, driving the compressed gas and materials through the connected nozzle containing a cylindrical conduit with a conical end, adjusting the materials flow is extended upward adjacent to the trigger for one hand operation.

19 Claims, 10 Drawing Sheets

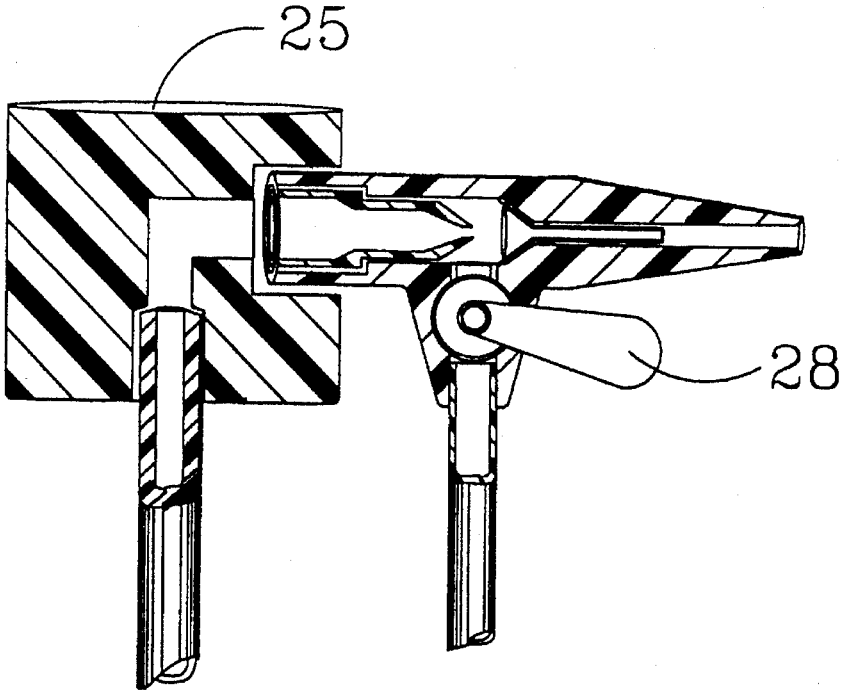
Fig 10a
Fig 10
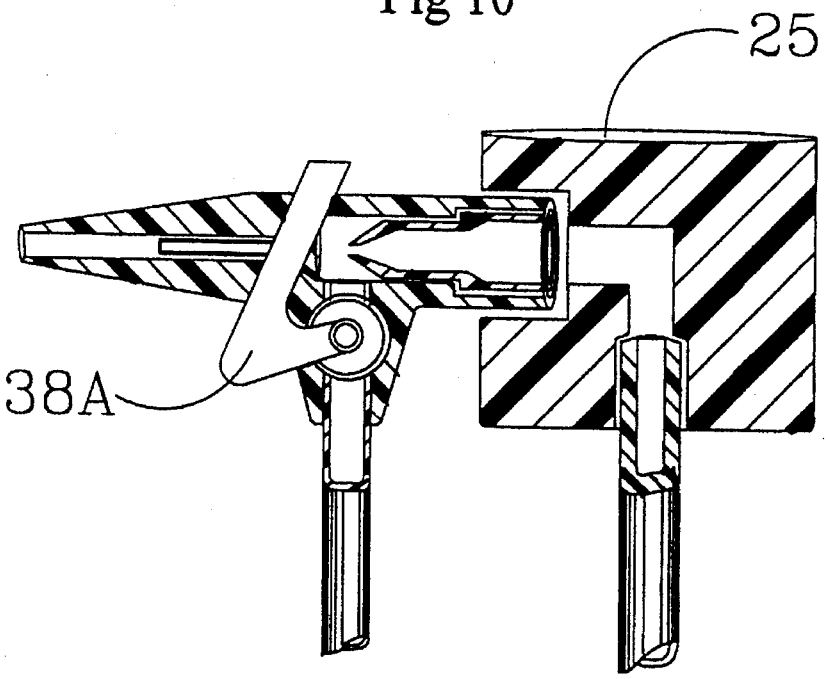

UNITARY, HAND-HELD, PORTABLE, SELF-POWERED REFILLABLE MIXED-MEDIA EJECTOR TOOL

BACKGROUND - FIELD OF INVENTION

This invention relates to an integrated hand held, refillable, serviceable, self-powered, portable ejector device for abrading the surface of glass, metal, or non-porous surfaces, for artistic design purposes, removing rust and corrosion and oxidation, and for ejecting a stream of granular, liquid or powdered material for any desired purpose.

BACKGROUND - DISCUSSION OF PRIOR ART

Numerous different designs and styles of particulate abrasive delivery tools have been proposed in the past, including portable assemblies incorporating an abrasive hopper, a nozzle and a trigger for initiating the delivery of the abrasive stream, such as U.S. Pat. Nos. 4,941,298: 4,628,644: 3,163,963 and 2,133,149. However, each of these assemblies requires the addition of a remote source of compressed air or other remote pressurized driving gas equipment to actuate the device. Other proposals employ separate or remote hoppers of abrasive particles, such as U.S. Pat. Nos. 4,090,334 and 4,674,239, but again, these patents also employ remote sources of compressed air as the source of the driving fluid. German patent publication DE 3624023 A1, proposes several different "portable sandblaster" devices incorporating a container of compressed propellant gas, but these German proposals lack valuable features and important advantages of the present invention.

I have carefully reviewed the two references newly cited by the British patent Examiner in his search report dated Oct. 12, 1992, on the counterpart British application, these references being the Impact UK application 2,102,315, and the Harden U.S. Pat. No. 3,704,811.

Granular particle ejector tools of the self-powered, manually portable type fall into two principal categories, and one minor secondary category, each having its own unique operational principals and advantages.

These are:

(1) The "vacuum" aspirator tools, such as the subject matter of this application, and, (2) the "pressure" ejector tools.

A third minor category of ejector tools, utilizing gravity to deliver the abrasive particles downward into a compressed gas stream.

This device also incorporates the use of a top hopper, for delivering the stream of abrasive, is proposed in Sauermann's German publication DE 3624023 A1 FIG. 1, also cited by the British Examiner.

All but one of the portable tools disclosed in the Impact and Harden references are "pressure" ejector tools: Impact FIG. 2 and all of the Harden figures show tools which deliver a propellant under pressure to the space above the stored particles in a particle hopper, to drive particles through a delivery conduit, These proposals all show a constricted region in the exit conduit, but in Impact FIG. 2 and Harden FIG. I, the stream of pressurized gas with any particles entrained therein enters the exit conduit before the constriction is reached, tending to cancel any negative pressure there induced by flow through the constriction, and subjecting the constricted exit conduit region to continuous particle-abrasion, rapidly destroying its usefulness.

Harden FIGS. 2 and 3 also show pressure-type ejector tools with the pressurized gas stream entering the exit conduit at the constriction or downstream very close thereto, again risking continuous abrasive destruction.

All of the Harden FIGS. 1, 2 and 3, show pressure diversion passages, e.g., 45 or 45*b*, delivering released compressed propellant into particle hoppers above the stored particles. However, Harden's propellant-delivery dip tube 20 leads to the bottom of his compressed propellant storage tank, risking the release of liquid phase propellant into these hoppers, which will turn the stored abrasive particles to mud, totally clogging the device and rendering it useless.

Inverting Harden's tool to expose his dip tube to compressed gaseous propellant also removes his powder dip tube 47 from the stored powder, disabling the device.

Harden apparently assumed that all of his stored propellant liquid would expand to form compressed gas upon release (col. 5, lines 25), but this will depend on the propellant chosen and the valve dimensions, making Harden's assumption unjustified. Harden's notion that pressure above the stored particles will "fluidize" them (col., 6, lines 49–53) is also in error, since a successful "fluidized bed" requires a plurality of compressed gas streams delivered from below, to raise and tumble the powder into a virtual sandstorm. The failure of Harden's devices to appear on the market over the two decades since his patent issued in 1972 proves the failure of Harden's theories.

Finally, none of these pressure-type tools contains a pressure relief valve to release the pressure of compressed propellant from above the stored particles in the hopper, and there is no way to avoid undesirable dribbling of pressure-propelled particles from the exit after the depressed ejector-actuator is released by the user.

In the Impact FIG. 2, pressure device, all of the propellant released through valve 28 is diverted down through tube 40 into a small bottom mixing chamber 36, where powder dropping through a one-way check valve 38 is theoretically blown by the pressurized propellant back up through an outlet tube 22*a* into the nozzle 24*a* at a point upstream from its modest constriction, This cancels any negative pressure induced at that constriction, and seriously abrades tubes 22*a* and 24*a*. This pressure device supplies no compressed propellant directly to the nozzle, and thus no vacuum aspiration is available; reliance upon a tiny one-way check-valve 38 for powder feed is totally unjustified, in my opinion, and its hoped for-operation, apparently activated by the pressure of compressed propellant in tube 40 and chamber 36, is not explained in the Impact text.

Impact FIG. 1 proposes a vacuum type ejector tool, but its delivery conduit 22 enters the exit conduit 24 upstream from the constriction, failing to take full advantage of any negative pressure induced there, and risking continuous abrasion damage to the constriction in exit conduit 24.

All of these prior art tools furthermore are lacking directional nozzles to deliver ejected particles to a specific small target area. Instead, they resemble "fire extinguisher" sprays, delivering a diverging stream of gas as an expanding cloud over a large target zone.

The most recent Patent, U.S. Pat. No. 5,181,349 The units shown in FIGS. 1, 3 through 10 are not serviceable, not easily refillable, and non-adjustable.

In particular, the nozzle, and the internal mixing chamber, are being constructed of a plastic material, tends to wear out quickly, due to particulate abrasive wear. Because of its non adjustability, it can cause more excess sand dispersion than necessary for home use. Another problem discovered, is that if while the venturi is in operation, it was to receive to much particulate material drawn from the reservoir chamber through the particulate delivery tube into the mixing chamber, a clogging will result and cause the mixing chamber to malfunction rendering the tool completely non-operational, and will repeatedly malfunction every time the trigger is depressed. This demonstrates that a particulate flow control valve is not only a nice accessory, but an absolute imperative to insure the working performance of the venturi effect inside the mixing chamber.

In addition, the snap on nature of the hopper base necessitates exact tolerances so as to be used with pressurized aerosol cans.

The tolerances of the outer-most upper rolled rim (lip) of an aerosol can cannot be held to the required tolerances needed by the hopper's base. Therefore, a good proportion of aerosol cans would not fit the device. The required tolerances required to insure that all propellant cans will fit the above unit is an impossible task, due to the fact that the industry manufacturing standards for such a product, with its thin wall construction, has a variable outside diameter as much as 24 one-thousands of an inch, where the manufactured hopper base requires a tolerance to be consistent within 10 one-thousands of an inch.

Further, refilling the sand reservoir chamber contained in the hopper is not possible as stated in the independent claim and is difficult and awkward in the dependent claim, which provides for dismantling and removing the entire top structure of the hopper in order to refill sand in that the nozzle, trigger, and central gas conduit assemblies would have to be removed from the hopper base prior to unscrewing the top of the hopper from the bottom of the hopper. If when Filling the hopper with particulate material, the abrasive gets into the central axial tube, the pressure relief valve would become filled with material and would cause the propellant container plunger valve to become clogged. If particulate material is forced up the gas delivery tube it will become lodged in the air jet's orifice, and, it would clog with the particulate material. Since the air jet is not serviceable or replaceable, the tool would then become inoperable and useless. Particulate material can interfere with the hopper's top screw assembly, causing threads to bind when it is to be re-mated with its hopper base, preventing a proper mating and sealing, and cause it to be inoperable.

In U.S. Pat. No. 5,181,349 the only use of an abrasive flow control regulator is implied in, FIG. 2., and no other reference is given to any of the other completely different embodiments or configurations. No additional information is given into the workings of such a device. It must be implied, that in order for this regulator to work, a twisting or screwing motion is used, requiring yet more threads, to provide a reliable, regulated flow of abrasive, thus, this configuration will also expose this regulator to the binding properties of abrasive material, and a threaded assembly.

An abrasive regulator suffers from the same abrading effects as does the internal mixing or venturi chamber, so careful considerations must be given to its internal configuration that must provide a long life for a re-fillable tool by either being uniquely designed internally, or offer a cheap simple serviceable solution to this problem. Simply stating that it is there does not mean that it will perform its designated job.

In reference to U.S. Pat. No. 5,181,349, FIGS. 1, 3, 4, and 5 clearly show that this embodiment has not considered any re-filling, abrasive flow control or any other considerations other than a one time, Disposable use device.

BRIEF SUMMARY OF THE INVENTION

The configuration of this invention incorporates a refillable supply hopper for particulate, powdered, or liquid material, a removable, rebuildable delivery nozzle and trigger, and the adjustable material flow control valve, combined with an approved source of pressure which is self contained and attached to the device with a special one time use adapter thus forming an integrated, portable, refillable, serviceable, and symmetrically balanced hand tool, permitting the user to transport the entire assembly conveniently in one hand to the project site, and using a simple top - trigger mechanism to initiate gas release from the approved source of pressure to provide venturi aspiration upward from the bottom of the refillable material supply materials reservoir chamber, mixing the gas and particulate material in the angular mixing chamber and delivery of a stream of abrasive particles, liquid or powder, directed by the replaceable nozzle, to the precise target site desired, using only one hand for operating and also for adjusting the material flow rate, and avoiding any need for connecting hoses, tubing, compressed air cylinders or any separate components whatsoever.

Accordingly, a principal object of the present invention is to provide an integrated, portable, reusable, serviceable, adjustable and self-powered granular particle, liquid or powder ejector tool combining the supply of materials with all the components necessary for their delivery to the desired site.

OBJECTS AND ADVANTAGES

Several objects and advantages of the present invention are:

a) to provide a nozzle and each of its internal parts are serviceable and replaceable.

b) to provide a nozzle and each of its individual parts which can be replaced when worn, c) to provide for material flow adjustability, with the same hand that is operating the tool, to allow the material flow to better meet the needs of the project being accomplished;

d) to provide for material flow adjustability so as to limit the release of too much material.

e) to provide for an aerodynamically designed angular mixing chamber to reduce internal abrasive wear.

f) to provide an internal aerodynamically designed replaceable air jet to increase pressure, better direct gas pressure, and reduce internal wear.

g) to provide a specially designed removable filler plug, incorporating a vent bore connecting outside ambient atmosphere to the inside of the material reservoir chamber, mounted on top of the reservoir chamber, as to provide for refilling the material repository easily and conveniently.

h) to provide a female adapter attached to the materials reservoir chamber which can be screwed on or otherwise attached to a breakable male adapter installed on an approved propellant can such that all cans will fit positively and that propellant can manufacturers will not be able to substitute their own propellant cans. The use of unauthorized aerosol cans for propulsion could be hazardous since the invention has been certified for gasses with exacting environmental and U.S. safety standards.

Further objects and advantages are to provide a Portable hand held refillable ejector tool which will be viewed as a refillable, serviceable, adjustable tool, rather than as a throw away. All of the objects of the invention have been to make the invention reusable, provide for serviceability wherever possible, and to prevent unauthorized sale of aerosol cans. The authorized aerosol cans have been tested for environmental and personal safety. Unauthorized cans would have no such restriction.

Further objects and advantages are to provide a portable, hand held ejector tool which is adjustable to the need of a particular project serviceable and refillable environmentally safe and personally safe to the user and onlookers; who will accomplish the abrading or frosting of glass, metal, and non porous surfaces for creating artistic designs through use of stencils or free form artistic creation. Further, to provide a stronger pressure than any prior art, for the removal of rust and erosion from such surfaces as car finishes, machinery parts, battery terminals and connectors, and any surface where rust and corrosion are present, or, the delivery of an ejected stream of liquid, powdered, or particulate material for any desired purpose whatsoever, such as, but not limited to, spraying paints, spraying glue, hard to get at surfaces, and to control water misting, using an integrated ejector tool.

SUMMARY RAMIFICATIONS AND SCOPE

Accordingly, the reader will see that the refillable, serviceable, adjustable nature of this invention, coupled with the increased pressure at the nozzle provided by the special air jet and mixing chamber, will provide the user with a tool which can:

be used repeatedly in continuing glass carving projects because of its reusable and refillable nature;

permit the material flow to be adjusted to the needs of the project and the material being sprayed;

expand usage for rust removal through the increased pressure at the nozzle;

be easily refilled by the simple removal of the filler plug; and.

be positively attached to the approved aerosol can to provide for environmental and personal safety.

Although the description above contains many specificity's, these should not be construed as limiting the scope of the invention but as merely providing illustrations of some of the presently preferred uses of this invention.

REFERENCE TO DRAWINGS

For a broader understanding of the objects of the invention, reference should be made to the following detailed description taken in connection with the accompanying drawings, in which:

FIGS. 10 AND 10A, shows an enlarged, cross-sectional side profile, showing two different flow control levers which can be easily interchanged, depending on the delicacy of the work being done.

PARTS LIST.

1. Complete Integrated Assembly.
2. Complete Hopper Housing.
3. Hopper Top Chamber.
4. Hopper Base.
5. Pressure tank's secondary rolled lip.
6. Uppermost rolled Lip of Aerosol Tank.
7. Pressurized Propellant Tank.
8. Depressable Plunger Valve.
9. Materials Reservoir Chamber.
10. Hopper Inner Wall.
11. Hopper Reservoir Floor.
12. Tapered Central Axial Tube.
13. Tapered Central Axial Columnar Bore.
14. Linear alignment guides.
15. Filler Plug.
16. Filler Plug Vent Bore.
17. Filler Plug Lip.
18. Hopper's Chamfered Seat.
19. Hopper Top.
20. Downward Protruding Central Collar.
21. Central Tapered Cylinder wall.
22. Hopper's Upper Peripheral Cylindrical Ledge.
23. Ringed Shaped Cylindrical Energy Director.
24. Hopper Top Recess.
25. Depressable Trigger.
25A. Trigger Nozzle Seat.
26. Gas Delivery Conduit Tube.
26A. Gas Delivery Conduit Tube's Inner Bore.
27. Gas Delivery Tube's Chamfered Terminus End.
28. Flow Control Valve Seat.
29. Ejector Nozzle Housing.
30. Ejector Nozzle's Exit Conduit Tube.
31. Nozzle Tip.
32. Material Delivery Conduit Tube.
33. Hopper Material Tube's Conduit Bore.
34. Advanced Mixing Aspiration Chamber.
35. Replaceable Air Jet.
35A. Air Jet With Angular Compression Chamber.
35B Air Jet's Orifice.
36. Conical Shaped Eyelet Tube.
36*a*. Compression Mounting Pads For Eyelet.
37. Material Flow Control Valve.
37A. Material Flow Control Valve Shaft.
37B. Flow Control Shaft Bore.
38. Material Flow Control Valve Lever.
38*a*. Snap Ring For Retaining Valve Lever.
38*b*. Flow Control Shaft's Shoulder.

39. Hoppers Lower Chamber.
40. Completed Adapter Assembly.
41. Female Adapter Plate.
41A. Female Adapter's Threads.
42. Male Adapter Plate.
42B Male Adapter's Threads.
43. Hoppers Lower Peripheral Cylindrical Ledge.
44. Male adapter's Circular Ribbed Flange.

BEST MODE FOR CARRYING OUT THE INVENTION

The embodiment of this invention shown in FIGS. 1 to 10*a*, will provide several unique advantages over any existing conceptions and is therefore considered to be the best mode for carrying out the invention.

Figure 1:
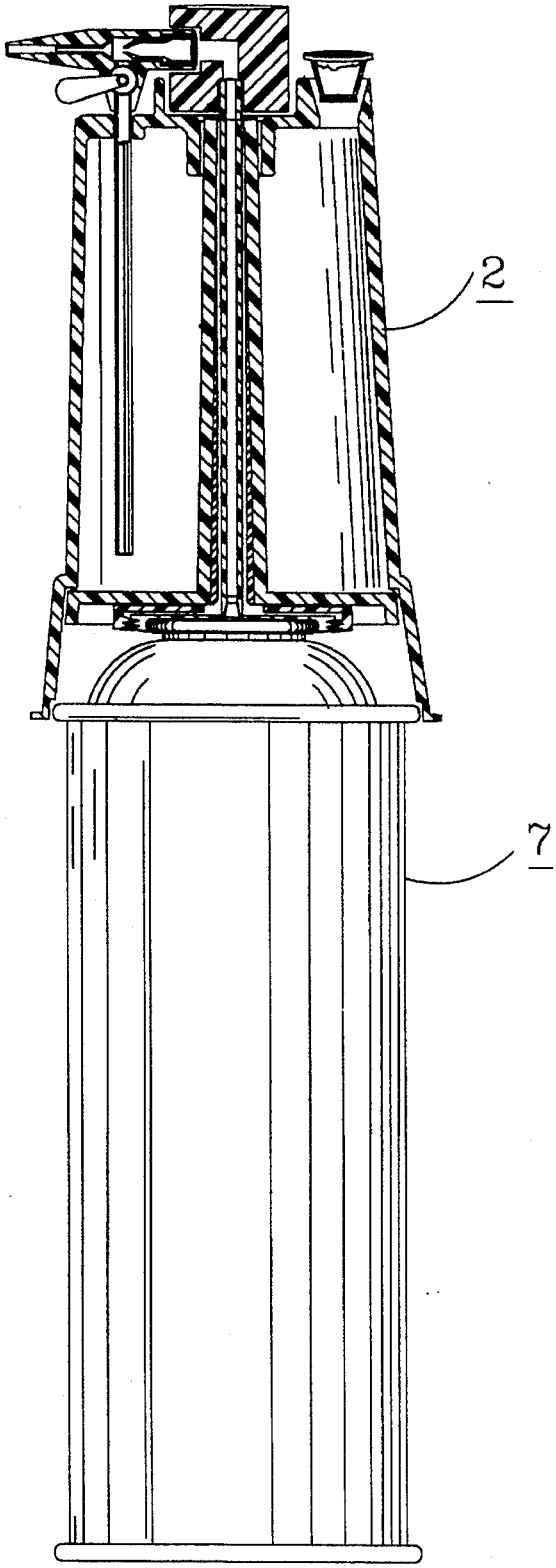
FIG. 1, is an assembled side perspective view, particularly in cross-section, showing the completed embodiment.

Completed assembly 1 consists of an "Aerosol" propellant tank 7 containing an axial type pressure relief valve 8 which is surrounded by an uppermost rolled rim 6 that is a standard assembly configuration of all "Aerosol" propellant tanks, which is mated to a unique adapter assembly 40 that provides a stable mounting platform for a top mounted hopper - trigger assembly capable of delivering a regulated supply of liquid or particulate material to a desired target site. A secondary rolled lip 5 is formed on the widest - topmost point of propellant tank 7 which provides a stable platform for completing the assembly, as seen in FIG. 1.

Figure 2:
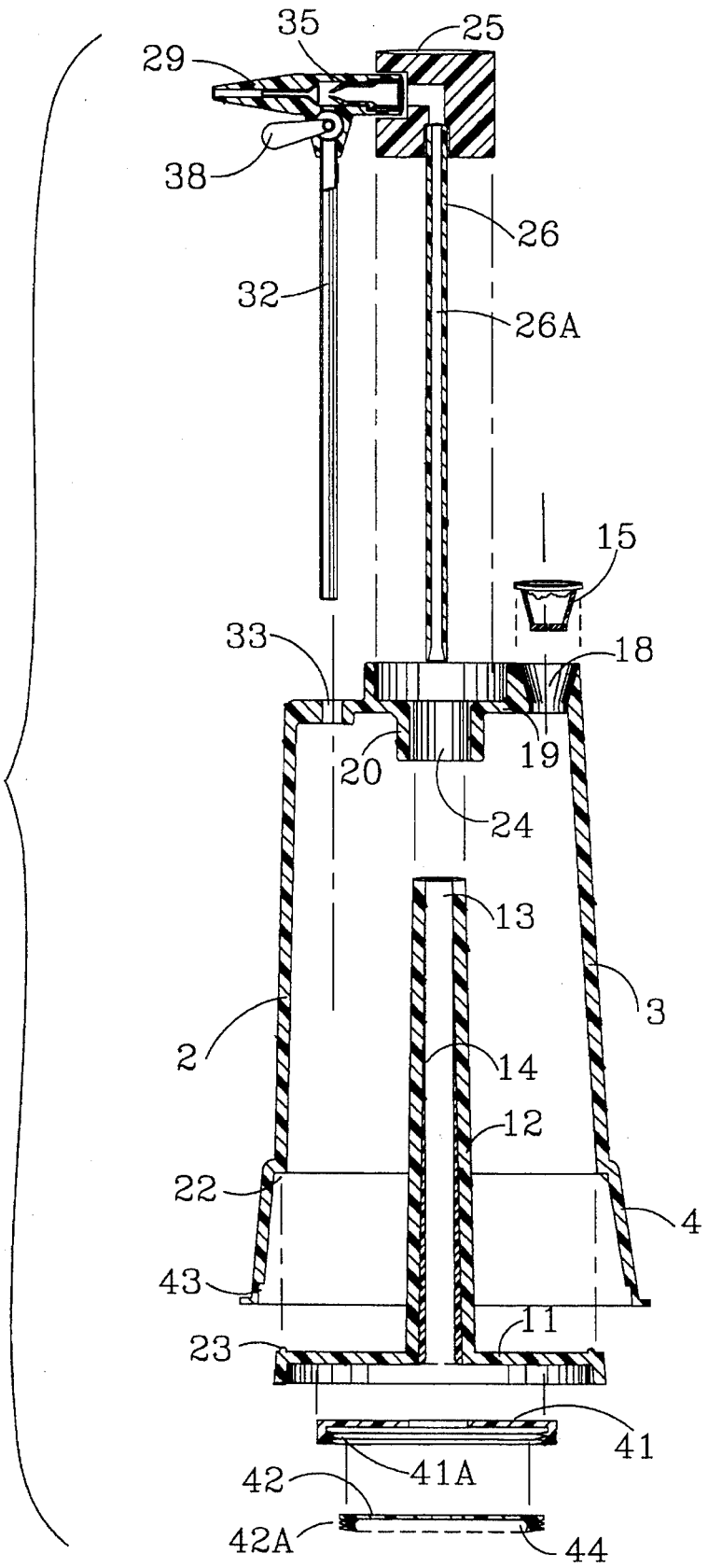
FIG. 2, is an exploded 3-Dimensional view of the embodiment, will all parts numbered, less the attachment of the propellant tank.
Figure 3:
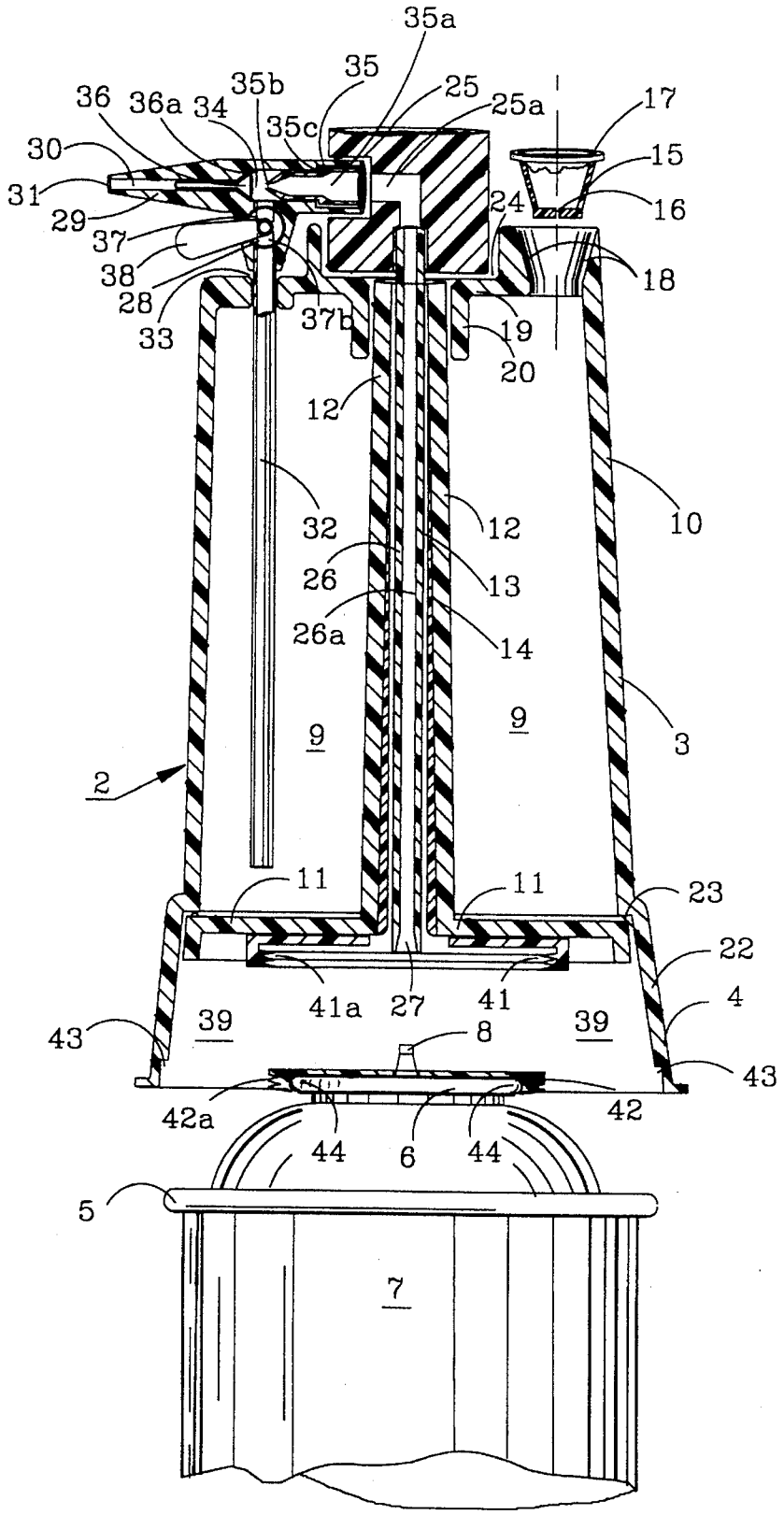
FIG. 3, is an enlarged fragmentary side elevation view of the hopper and trigger-nozzle-propellant tank illustrating the assembled interrelationship between all parts.
Figure 4:
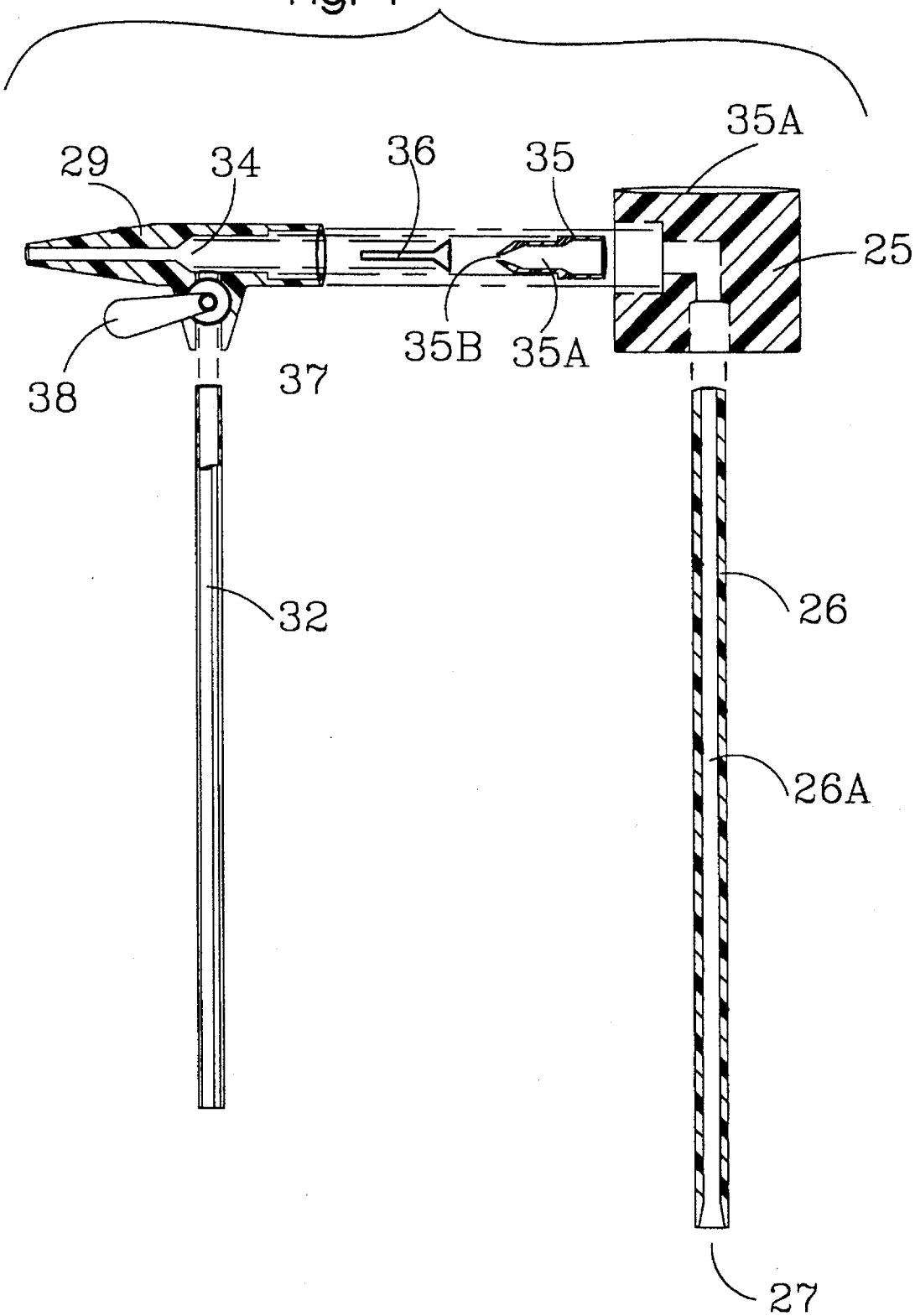
FIG. 4, is a cross-sectional, exploded, side elevation view of the nozzle - trigger assembly showing the unique configuration of this rebuildable sub-assembly and particularly pointing out the conical shaped eyelet and air jet removed from the nozzle housing.
Figure 5:
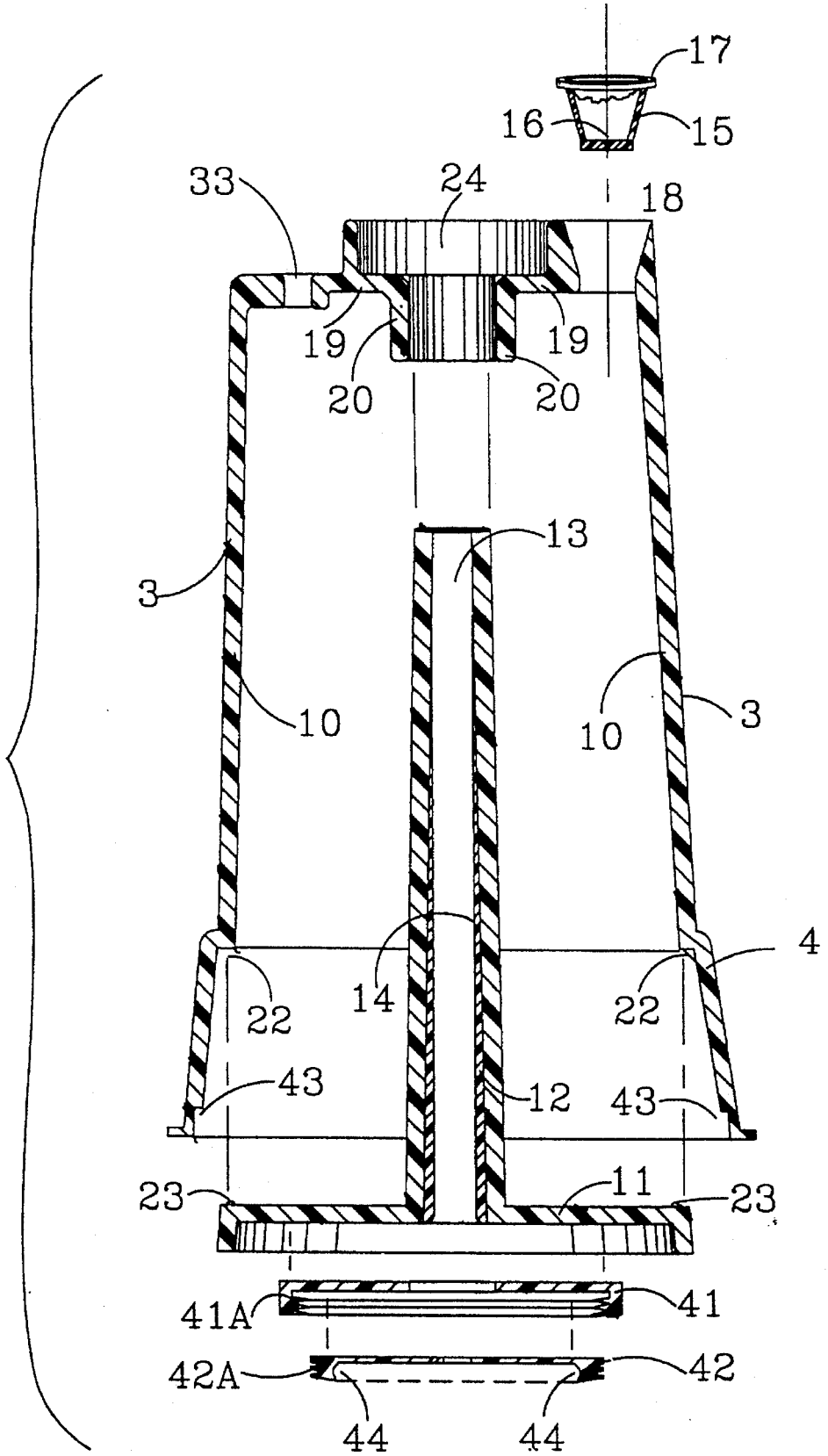
FIG. 5, is an exploded, cross-sectional view of the hopper housing 2, and the central axial tube/hopper floor, particularly pointing out the interrelationship between them.

Illustrated in FIGS. 2 and 3, male adapter plate 42 will engage the uppermost rolled rim 6 of propellant tank 7 by means of a hollow ring-shaped, ribbed flange 44 that will provide a tight snap fit, and is designed of a suitable material that will break if sufficient force is applied in an attempt to remove it from propellant tank 7. Male adapter plate 42 will engage the female adapter plate 41 by means of mateable threads on its outermost circular rim 42A. Female adapter plate 41 is a hollow donut shaped adapter with a hollow inner peripheral diameter containing mateable receiving threads 41A mateable to male adapter plate's threads 42A. Female adapter plate 41 is molded into or sonic welded onto the underside of hopper's abrasive reservoir chamber's floor 11, that contains an upwardly protruding tapered central axial tube 12 containing a tapered central axial bore 13 that houses four linear alignment guides 14.

FIG. 3, illustrates hopper housing 2 is composed of a hopper top 3 forming a ringed shaped materials reservoir chamber 9, and a hopper base 4 which contains the adapter mounting platform on the underside of hopper's materials reservoir floor 11, and pressure relief chamber 36.

Figure 6:
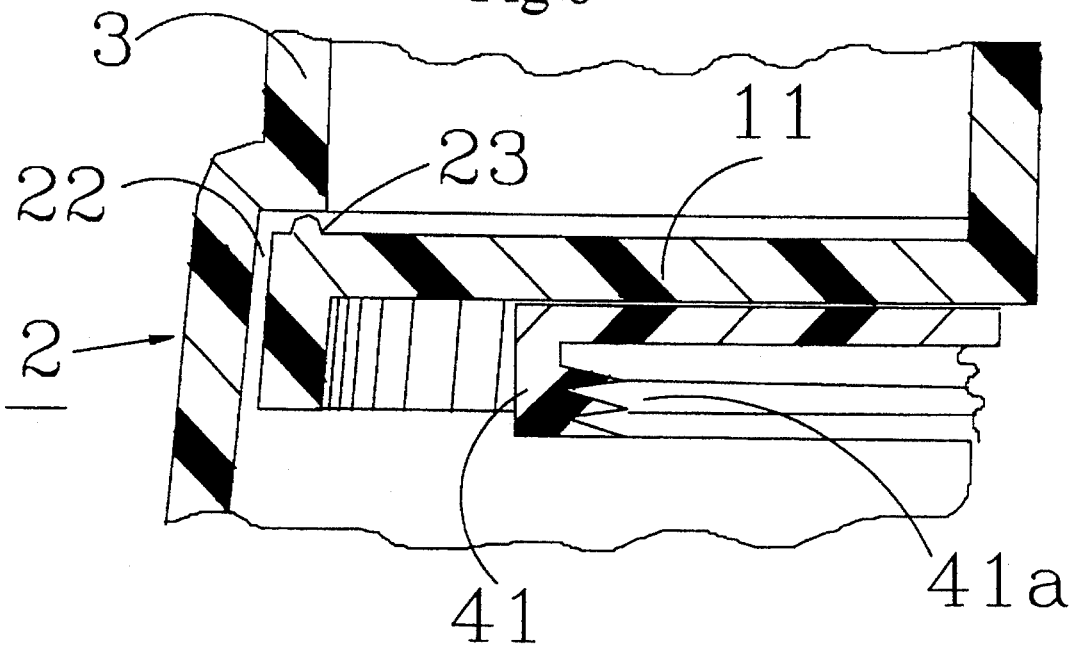
FIG. 6, is an enlarged cross-sectional view showing hopper base's upper peripheral ledge, and the hopper's floor, particularly pointing out the ringed energy director's fusing point to the hopper and their related mating positions prior to sonic welding.
Figure 7:
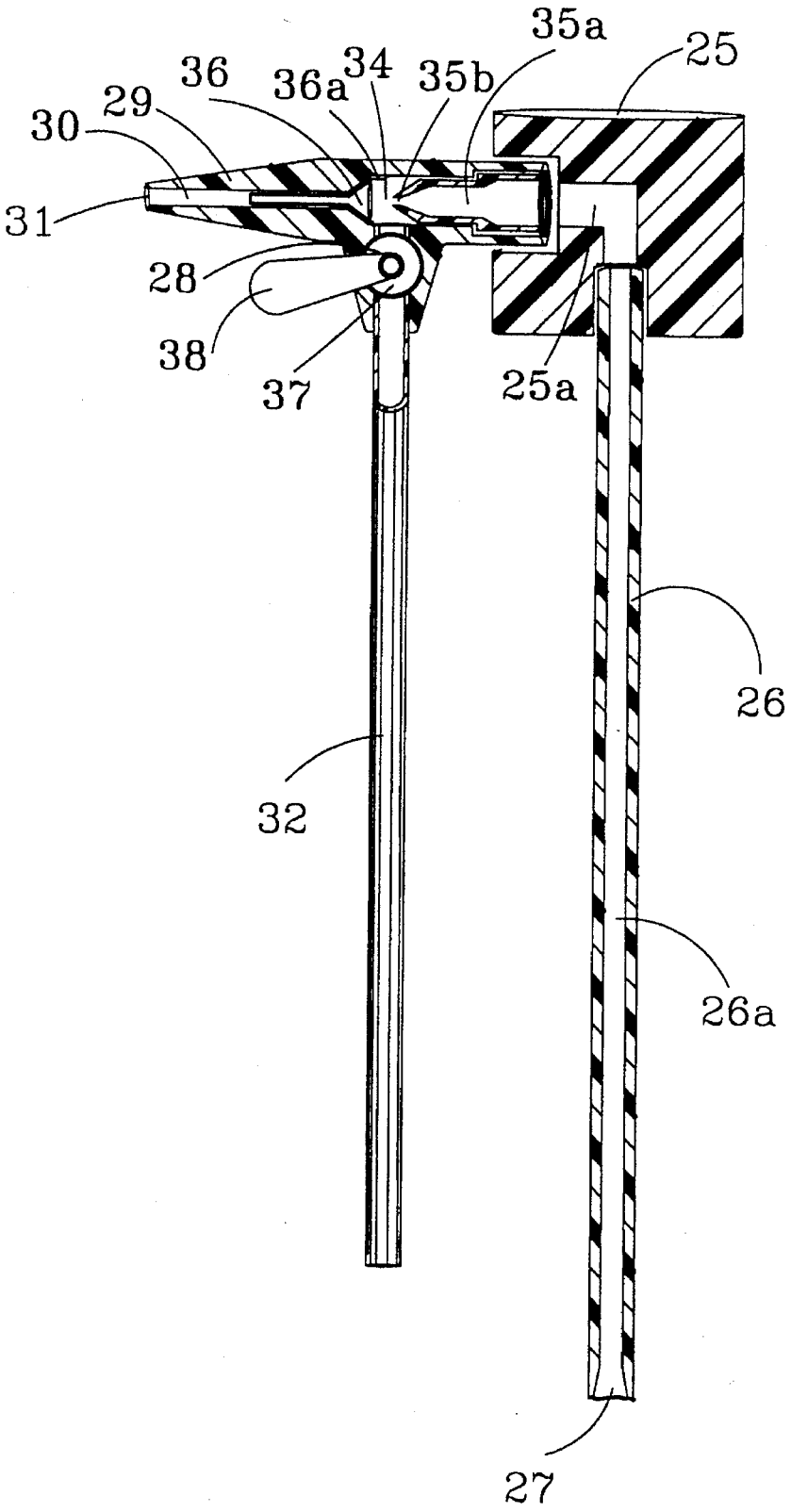
FIG. 7, is a detailed cross-sectional side elevation view of the removable, serviceable, trigger-nozzle sub-assembly shown in FIGS. 1, 2, and 3.

FIG. 6, illustrates the tapered central axial tube 12, and the materials reservoir floor 11 built in a one piece construction, and which is inserted into the hollow hopper housing 2 from its widest bottom-most opening. Hopper floor's 11 outermost circular rim contains a ring-shaped projection that forms a sonic energy director 23. As hopper's abrasive reservoir floor 11, and central axial tube are being inserted into the hollow hopper 2, the ring-shaped energy director engages the hoppers upper peripheral ledge 22, and when a sufficient supply of sonic energy is applied to hopper's abrasive reservoir floor 11, the sonic energy director will melt, fusing upper peripheral ledge 22 and abrasive reservoir floor 11 into a single unitized construction.

As illustrated in FIG. 3, upon above assembly, two distinct chambers are formed, Hopper top 3 and hopper base 4. Hopper top 3 encloses an internal ring-shaped reservoir chamber 9 for holding granular particulate or liquid material, which is bounded by a circular wall 10, a floor 11, a hopper roof 19, and a columnar central axial tube 12 enclosing a tapered central bore 13 containing four linear alignment guides 14, extending vertically through hopper top 3, which completes the seal of chamber 9. Hopper housing 2 overlays plunger valve 8 when mated to the propellant tank 7 using with completed adapter assembly 40 composed of a male adapter plate 42 and a female adapter plate 41.

Complete hopper housing 2 will be positioned on top of propellant tank 7, with ring-shaped male adapter plate 42 mated with propellant tank's 7, uppermost rolled rim 6 by means of a ribbed, undercut flange 44. Male adapter plates 42 threads 42A and ring-shaped female adapter plate's threads 41A will interlock by means of a screwing motion which mate threads 41A and 42A, simultaneously engaging lower peripheral ledge 43 of hopper housing 2 and the secondary rolled rim 5 of propellant tank 7 assuring a secure mount during all normal operational conditions.

As illustrated in FIGS. 2 and 3, depending axially downward from depressible trigger 25 is a ridge hollow gas delivery conduit tube 26 containing an inner conduit bore 26A, and extending through the tapered central axial tube's bore 13, which is guided parallel along the linear alignment guides 14 through the ring-shaped female adapter plate's 41 open central axial diameter, through the male adapter plate's 42 open central axial diameter, and engages depressable plunger valve 8 of pressure tank 7. The internal pressure inside the pressurized propellant tank 7 maintains plunger valve 8 in the closed position. The user's finger pressure is applied axial downwardly to depress trigger 25 which overcomes the tanks internal pressure, releasing propellant gas from tank 7, through depressable plunger valve 8, The released compressed gas is directed into the gas delivery tube's distal chamfered terminus end 27 and up through the gas delivery conduit 26A, into and through the trigger 25 and the nozzle housing 29 having its proximal end anchored in the lateral bore of the trigger, which contains a nozzle seat, and extends radically from the trigger with its distal end opening into an ejection nozzle tip 31. The compressed gas enters a replaceable air jet 35 containing an advanced angular compression chamber which serves to compresses and focuses the gas stream into a linear flow pattern, which then exits through a reduced diameter orifice 35B. into and through the angular mixing chamber 34, containing a replaceable conical ended conduit eyelet 36, that is produced a sufficient wear resistant material. A venturi effect is produced and negative aspiration is developed providing negative atmospheric pressure into the abrasive delivery conduit 32 drawing out the particulate material from the ring-shaped reservoir chamber 9. Depending downwardly from the mixing chamber 34 is the materials delivery conduit 32 extending substantially downward and parallel to the gas delivery tube 26 through hopper's access bore 33 and into the lower interior portion of reservoir chamber 9.

Figure 9:
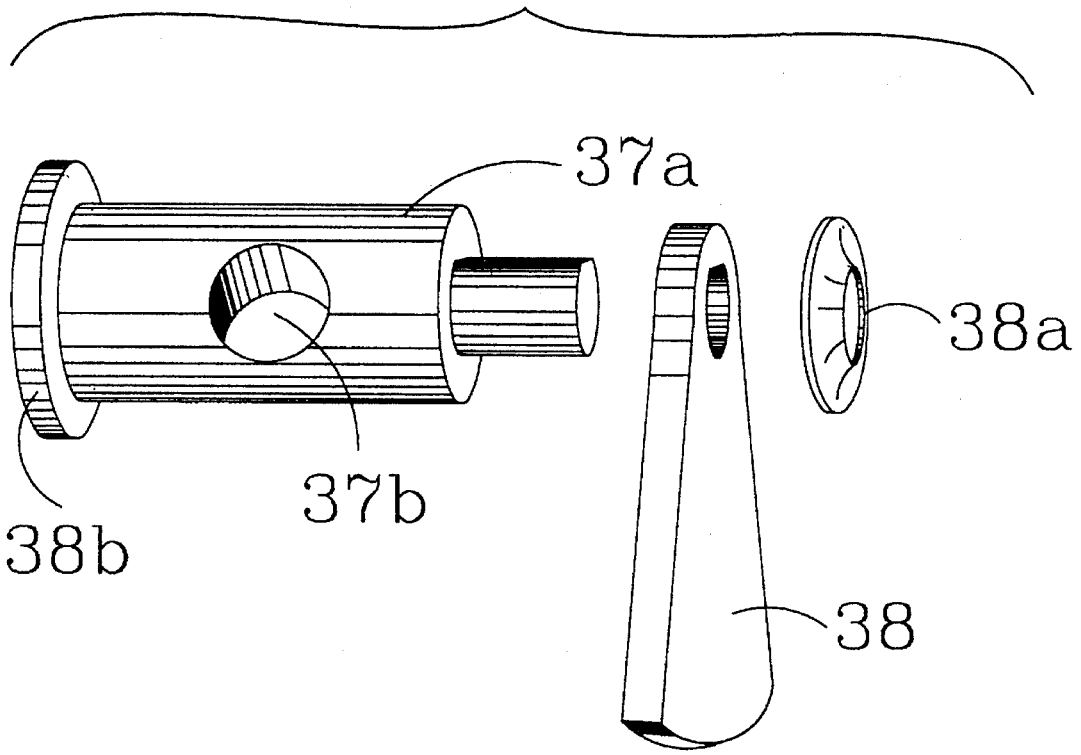
FIG. 9, is an enlarged, detailed, 3-Dimensional perspective view of the flow control lever, flow control shaft with its flow control bore, which is partially shown in FIG. 8.

As illustrated in FIG. 9, intersecting the materials delivery conduit 32 is a flow control valve 37 that regulates the flow of material by means of a wear resistant flow control shaft 37A containing a flow control bore 37B that is controlled by flow control lever 38 that rotates the cylindrical shaft 37A, when moved thus, restricting the materials flow through the valve assembly 37 and is retained in seat and in position onto shaft 37A by a snap ring 38A, and whose distal end contains a shoulder that securely holds flow control shaft in a stable mounting 37A firmly in its valve seat 28 that is formed into the nozzle housing 29.

Figure 8:
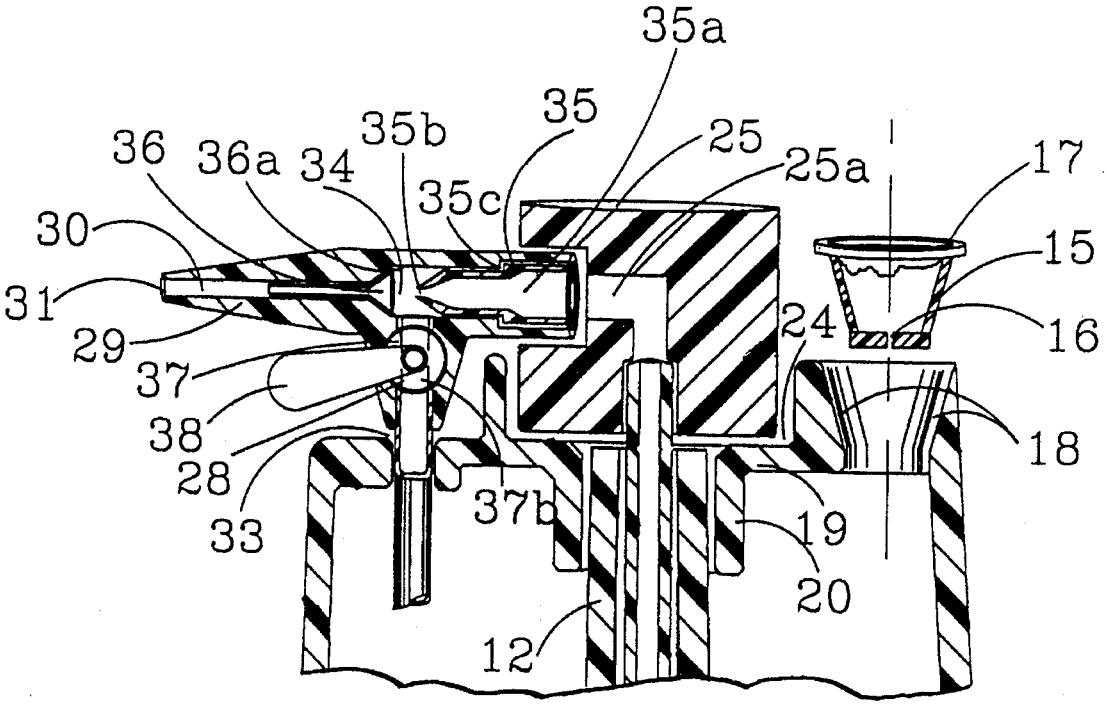
FIG. 8, is an enlarged, fragmentary, side elevation view of the internal nozzle assembly, particularly pointing out the detailed internal configuration and interrelated assembly of all nozzle components.

FIG. 8 illustrates that the particulate materials from material delivery tube 32 and the compressed gas from the air jet's orifice 35B converge in the mixing chamber 34. The stream of compressed gas and the particulate material is now focused by the internal configuration of the air jet 35 which directs the mixed media into a replaceable tubular conical ended eyelet 36, which is held securely in position by a set of mounting compression pads 36A. The conical eyelet 36 protects the angular mixing chamber 34 from wear due to abrasion, by the improved reduction of the internal drag coefficient of the particulate material, and by reducing any sharp angular obstructions leading into the conical eyelet's receiving chamber, which then directs and focuses the materials media into still another focused pattern as it travels through the ejector nozzles cylindrical conduit tube 30 and exits through the nozzles tip 31, toward its directed target.

As shown in FIG. 3, hopper's lower chamber 39 is continually vented in the advent of a minor compressed gas leak, from gas delivery tubes chamfered terminus seat 27, between long parallel linear air cavities between the hopper's tapered central axial tube's 12 bore 13 and the linear alignment guides 14 that guides the gas delivery conduit into a mateable position with tank's 7 plunger valve 8. Excess gas pressure is collected in these air cavities and is expelled through a non-airtight fit between the gas delivery tube 26 and the inside of central axial tube 12, inner bore 13 and out through the hopper's top recess 24.

Re-filling hopper's abrasive reservoir chamber 9 is achieved by grasping the filler plug's 15 outermost lip 17 to remove it from its chamfered seat 18 located in the hoppers top 19. Hopper's abrasive reservoir 9 is vented through a centrally located bore 16 located in plug 15, vent bore 16 keeps the hopper's reservoir chamber 9 in a state of equilibrium by maintaining atmospheric pressure, as illustrated in FIG. 3.

Deterioration of the mixing chamber is due to particulate abrasion during the operation of the tool, and the greater the amount of sharp obstructive angles inside the mixing chamber, the faster the mixing chamber will deteriorate due to particulate abrasive wear, so intern the faster the mixing chamber and nozzle will become inefficient and render the tool completely inoperable. This design incorporates unique aerodynamic principals in the removable air jet 35, and the conical eyelet 36 and the mixing chamber 34, that will minimize the internal wear to a nozzle housing thus insuring a long and useful life. The complete serviceability, and replaceability of all singular components will also insure that unwanted damage to the internal mixing chamber will also insure its longevity.

FIG. 10 and 10*a* illustrates the ease of converting the control lever from a single side mounted lever FIG. 10 to a conveniently operated, top mounted flow control lever FIG. 10A.

The embodiment of this invention is relatively light in weight, symmetrically balanced, self-powered, serviceable, and conveniently portable tool, and is operable by the user with one-hand operation. The user is thereby provided with a single unitary self-powered tool for the delivery of abrasive powers and other granular or liquid materials to any desired target site, without requiring both hands to carry and actuate the unit, avoiding the encumbrances of compressors, large compressed gas tanks, hose, tubing and the like.

It will thus be seen that the objects set fourth above and those made apparent from the preceding description are efficiently attained and, since certain changes may be made in the above constructions without departing from the scope of the invention, it is intended that all matter contained in the above description or shown in the accompanying drawings shall be interpreted as illustrative and not in a limiting sense.

It is also understood that the following claims are intended to cover all of the generic and specific features of the invention herein described and all statements of the scope of the invention which, as a matter of language, might be said to fall therebetween.

What is claimed is:

1. An integrated, portable, hand held, adjustable refillable, re-buildable, self powered tool for ejecting a stream of abrasive particulate, powdered, or liquid materials toward a target site comprising:

a hollow materials reservoir chamber, accommodating a supply of abrasive granular particulate, powdered, or liquid materials connected by a special adapter to and supported by a mateable adapter attached to a pressurized container;

a removable filler plug, removable from a chamfered seat in top of the hollow materials reservoir chamber, or any convenient location, for material refilling, wherein the improvement comprises the removable filler plug, a filler plug vent bore, incorporated into the removable filler plug, connecting ambient atmosphere to the inside of the material reservoir chamber, wherein the improvement consists of the vent bore in the removable filler plug, a hopper top with a downward protruding central collar supporting a central axial conduit whose internal bore directs the gas delivery tube attached to the trigger to alignment with propellants depressable plunger valve, by means of the linear alignment guides, wherein the improvement consists of the linear alignment guides, a gas delivery conduit in a trigger assembly to direct compressed gas to a replaceable air jet, wherein the improvement consists of the replaceability of the removable air jet, a gas delivery conduit in the trigger assembly to direct released gas to the air jet containing angular compression chambers exiting to a reduced diameter orifice for the further compression and adjustment of the compressed gas stream, wherein the improvement consists of the angular compression chambers contained in the air jet;

an angular mixing aspiration chamber constructed inside the nozzle housing, for mixing of abrasive particulate, powdered, or liquid materials and gas, a replaceable ejector nozzle housing containing the advanced mixing aspiration chamber, wherein the improvement consists of the replaceability of the nozzle housing assembly, a material delivery conduit tube connecting the advanced mixing aspiration chamber with the bottom of the material reservoir chamber, through a flow control adjustment valve assembly, a replaceable cylindrical tube with a conical end, made of a suitable wear resistant material, such as steel or rubber, lining the nozzles exit conduit, positioned to produce enhanced negative pressure promoting aspiration of materials from the materials reservoir chamber from the delivery conduit to the advanced mixing aspiration chamber, wherein the improvement consists of the replaceable cylindrical tube with a conical end to reduce wear of the nozzle exit conduit, a replaceable materials control valve connected and intersecting the material delivery conduit tube, wherein the improvement consists of the materials control valve, a flow control valve composed of a flow control shaft containing a bore, and a control valve lever to adjust the flow of materials from the materials reservoir chamber, wherein the improvement consists of the replaceable flow control valve and its components for the adjustment of the flow of materials, all of said components being combined in an integrated, symmetrically balanced, refillable, adjustable, parts replaceable, hand held portable assembly which can be seized, carried, adjusted, aimed and operated by the user in only one hand, wherein the improvements consist of the refillable, adjustable and parts replaceable nature of the invention.

2. The integrated refillable ejector tool defined in claim 1 wherein the materials reservoir chamber, trigger and nozzle assemblies are combined as a single assembly mounted on a propellant container with a pending adapter assembly, wherein the improvement consists of the pending adapter assembly.

3. The integrated refillable ejector tool defined in claim 2 wherein the pending adapter plate is sonic welded or molded to the underside of the material reservoir chamber floor, wherein the improvement consists of the pending adapter plate.

4. The integrated refillable ejector tool defined in claim 3 wherein a pending adapter plate is attached to an approved aerosol propellant container, wherein the improvement consists of the pending adapter plate.

5. The integrated refillable ejector tool defined in claim 4 wherein the pending adapter plate on the material reservoir floor, is fitted to the pending adapter plate on the propellant container, wherein the improvement consists of the fitting of a male adapter plate to a female adapter plate, forming a unique mounting assembly.

6. The integrated refillable ejector tool defined in claim 1 wherein the nozzle, trigger, and material delivery conduit tube assembly, and the adjustable valve assembly is detachable for cleaning and replaceable as a complete assembly, wherein the improvement consists of the detachability and replaceability of the complete flow control valve assembly.

7. The integrated refillable ejector tool defined in claim 6 wherein the removable cylindrical tube with the conical end is seated into mounting compression pads, contained inside the nozzles housing, wherein the improvement consists of the seating of the removable cylindrical tube in compression mounting pads instead of being permanently attached.

8. The integrated refillable ejector tool defined in claim 7 wherein the nozzle assembly, and each of its parts, including the cylindrical tube with the conical end, the air jet, and the adjustment valve are detachable individually from the trigger assembly for service or replacement, whereby each part is detachable for cleaning and replacement, wherein the improvement consists of the individual detachability of each part.

9. The integrated refillable ejector tool defined in claim 1 wherein the inclined angles of the air jet compresses and directs the propellant gas through the air jet orifice into the angular mixing aspiration chamber, wherein the improvement comprises the compression of gas through the inclined angles of the air jet to increase the power of the tool.

10. The integrated refillable ejector tool defined in claim 1 wherein a materials control valve intersects the materials conduit tube, wherein the improvement comprises the materials control valve and its intersection with the materials delivery conduit tube.

11. The integrated refillable ejector tool defined in claim 10, wherein the materials control valve lever is attached to the material control valve shaft containing a flow control shaft bore whereby material flow is controlled by moving the material control lever, wherein the improvement comprises the ability to control the flow of material.

12. The integrated refillable ejector tool defined in claim 1 wherein the filler plug incorporating the vent bore for connecting ambient atmosphere to the inside of the material reservoir chamber, whereby extracting the plug from the materials reservoir chamber provides an aperture to refill said chamber with material, wherein the improvement consists of the filler plug and the aperture for refilling the material reservoir chamber.

13. The integrated refillable ejector tool defined in claim 12, wherein the material delivery conduit tube is substantially parallel to the gas delivery tube, with said material conduit and said gas delivery tube being slidably mounted for a reciprocating movement in the slide-apertures formed in the materials reservoir chambers roof, whereby depressing actuation of the depressible trigger actuates the propellant tank's plunger valve, releasing compressed gas into the gas delivery tubes bore and through the air jets orifice, into the advanced angular mixing chamber to produce negative atmospheric pressure creating a venturi effect, aspirating material from the lower end of the materials reservoir chamber to the advanced angular mixing aspiration chamber, whereby the pressurized gas is focused by the air jet, mixes with the material and delivers a stream of compressed gas and material through the nozzles internal conduit to the target site, wherein the improvement consists of the air jet compression and focusing abilities enhances the pressure pattern of the gas driving the stream of material through the nozzle.

14. The integrated refillable ejector tool defined in claim 13, wherein the material control lever is connected to a flow control shaft which intersects the material delivery conduit tube, whereby movement of said lever adjusts the flow of material matching to the needs of the project.

15. The integrated refillable ejector tool defined in claim 14, wherein the said lever for adjusting the materials flow is extended upward adjacent to the nozzle assembly and in close proximity of the depressable trigger will provide for one hand operation, whereby the improvement is; the extension of the flow control valve will allow for the adjustment of the materials flow into the mixing chamber from the reservoir chamber with a one finger movement while simultaneously depressing the trigger.

16. An integrated male and female adapter for mating compressed gas container with ejector tools which direct the gas at a target, either carrying or not carrying other material with it comprising;

a female adapter which can be glued, molded or otherwise permanently attached to a device which directs gas to a target, a male adapter which can be snapped on or otherwise attached to compressed gas container, a screw arrangement in the male adapter which will mate with the female adapter, a screw arrangement in the female adapter which will mate with a screw arrangement in the male adapter.

17. The adapter defined in claim 16 wherein the male adapter is composed of a material which will allow it to be snapped onto a compressed gas containers uppermost rolled rim, but will break if an attempt is made to remove it.

18. The adapter defined in claim 17, wherein the screw arrangement in the male and female adapter device is a snap on device,

19. The adapter defined in claim 16 wherein the screw arrangement in the male and female adapter device is a fitted bayonet device, or any arrangement which allows for positive secure mating between the male and female adapter devices.

* * * * *